US010838326B2

(12) United States Patent
Sato

(10) Patent No.: US 10,838,326 B2
(45) Date of Patent: Nov. 17, 2020

(54) IMAGE FORMING APPARATUS

(71) Applicant: BROTHER KOGYO KABUSHIKI KAISHA, Nagoya (JP)

(72) Inventor: Shougo Sato, Seto (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/592,010

(22) Filed: Oct. 3, 2019

(65) Prior Publication Data

US 2020/0033762 A1 Jan. 30, 2020

Related U.S. Application Data

(63) Continuation of application No. 16/235,478, filed on Dec. 28, 2018, now Pat. No. 10,437,176, which is a (Continued)

(30) Foreign Application Priority Data

Oct. 18, 2016 (JP) ..... 2016-204511

(51) Int. Cl.
*G03G 15/01* (2006.01)
*G03G 15/16* (2006.01)
(Continued)

(52) U.S. Cl.
CPC ..... *G03G 15/1605* (2013.01); *G03G 15/234* (2013.01); *G03G 15/6502* (2013.01); *G03G 15/657* (2013.01); *G03G 21/1604* (2013.01)

(58) Field of Classification Search
CPC ..... G03G 15/1605; G03G 15/234; G03G 15/6502; G03G 15/657; G03G 21/1604; G03G 21/10; G03G 21/105; G03G 21/161
See application file for complete search history.

(56) References Cited

U.S. PATENT DOCUMENTS

2001/0031153 A1 10/2001 Sameshima et al.
2003/0147678 A1 8/2003 Ozawa et al.
(Continued)

FOREIGN PATENT DOCUMENTS

JP 2003-131472 A 5/2003
JP 2003-167402 A 6/2003
(Continued)

OTHER PUBLICATIONS

Notice of Reasons for Refusal issued in corresponding Japanese Patent Application No. 2016-204511, dated Sep. 23, 2020.

*Primary Examiner* — Hoang X Ngo
(74) *Attorney, Agent, or Firm* — Merchant & Gould P.C.

(57) ABSTRACT

An image forming apparatus, having a photosensitive drum, an intermediate transfer belt located at a lower position with respect to the photosensitive drum to contact the photosensitive drum, a secondary transfer roller contacting the intermediate transfer belt, a first sheet tray located at a lower position with respect to the intermediate transfer belt to store a sheet, and a sheet guide to guide the sheet stored in the first sheet tray to a position between the intermediate transfer belt and the secondary transfer roller, is provided. The sheet guide is located between the intermediate transfer belt and the first sheet tray with regard to a vertical direction and has a curved section. A contact area between the secondary transfer roller and the intermediate transfer belt is located at a lower position with respect to an upper end portion of the curved section.

16 Claims, 9 Drawing Sheets

Related U.S. Application Data continuation of application No. 15/701,699, filed on Sep. 12, 2017, now Pat. No. 10,185,253.

(51) Int. Cl.

| | |
|---|---|
| ***G03G 15/00*** | (2006.01) |
| ***G03G 15/23*** | (2006.01) |
| ***G03G 21/16*** | (2006.01) |

(56) References Cited

U.S. PATENT DOCUMENTS

| | | | | |
|---|---|---|---|---|
| 2007/0048008 | A1 | 3/2007 | Kamimura | |
| 2007/0292179 | A1* | 12/2007 | Kudo | G03G 15/161 399/358 |
| 2010/0247173 | A1 | 9/2010 | Okabe | |
| 2012/0027459 | A1 | 2/2012 | Sato | |
| 2013/0071165 | A1 | 3/2013 | Kitamura | |
| 2013/0308976 | A1 | 11/2013 | Sekido | |
| 2015/0309447 | A1 | 10/2015 | Suzuki et al. | |

FOREIGN PATENT DOCUMENTS

| | | | |
|---|---|---|---|
| JP | 2003-173066 | A | 6/2003 |
| JP | 2005-157112 | A | 6/2005 |
| JP | 2006-38989 | A | 2/2006 |
| JP | 2007-57646 | A | 3/2007 |
| JP | 2007-286106 | A | 11/2007 |
| JP | 2010-230775 | A | 10/2010 |
| JP | 2012-32610 | A | 2/2012 |
| JP | 2013-64953 | A | 4/2013 |
| JP | 2013-242439 | A | 12/2013 |
| JP | 2013-250366 | A | 12/2013 |

* cited by examiner

IMAGE FORMING APPARATUS

CROSS-REFERENCE TO RELATED APPLICATION

This application is a continuation of U.S. patent application Ser. No. 16/235,478, filed Dec. 28, 2018, which is a continuation of U.S. patent application Ser. No. 15/701,699, filed on Sep. 12, 2017, both of which claim priority under 35 U.S.C. § 119 from Japanese Patent Application No. 2016-204511, filed on Oct. 18, 2016. The entire subject matter of each of these applications are incorporated herein by reference.

BACKGROUND

Technical Field

The following disclosure is related to an aspect of an image forming apparatus.

Related Art

An image forming apparatus, having a photosensitive drum, an intermediate transfer belt, a secondary transfer roller, a sheet tray, and a sheet guide, is known. The intermediate transfer belt may be arranged at a lower position with respect to the photosensitive drum and contact the photosensitive drum. The secondary transfer roller may be arranged to contact the intermediate transfer belt. The sheet tray may be arranged at a lower position with respect to the intermediate transfer belt and store sheets. The sheet guide may guide the sheets in the sheet tray to a position between the intermediate transfer belt and the secondary transfer roller. The guide may have a curved section.

BRIEF SUMMARY

The image forming apparatus with these components may tend to leave vertically unoccupied spaces inside a housing. The vertically unoccupied spaces may cause difficulty in reducing a volume of the image forming apparatus in a vertical direction.

The present disclosure is advantageous in that an image forming apparatus, of which volume may be reduced in a vertical direction, is provided.

According to an aspect of the present disclosure, an image forming apparatus, having a photosensitive drum; an intermediate transfer belt located at a lower position with respect to the photosensitive drum, the intermediate transfer belt contacting the photosensitive drum; a secondary transfer roller contacting the intermediate transfer belt; a first sheet tray configured to store a sheet, the first sheet tray being located at a lower position with respect to the intermediate transfer belt; and a sheet guide configured to guide the sheet stored in the first sheet tray to a position between the intermediate transfer belt and the secondary transfer roller, the sheet guide being located between the intermediate transfer belt and the first sheet tray with regard to a vertical direction, the sheet guide having a curved section, is provided. A contact area between the secondary transfer roller and the intermediate transfer belt is located at a lower position with respect to an upper end portion of the curved section.

EMBODIMENTS

Hereinafter, an image forming apparatus 1 according to a first embodiment of the present disclosure will be described with reference to FIGS. 1-7.

First Embodiment

1. Overall Configuration of Image Forming Apparatus

Figure 1:
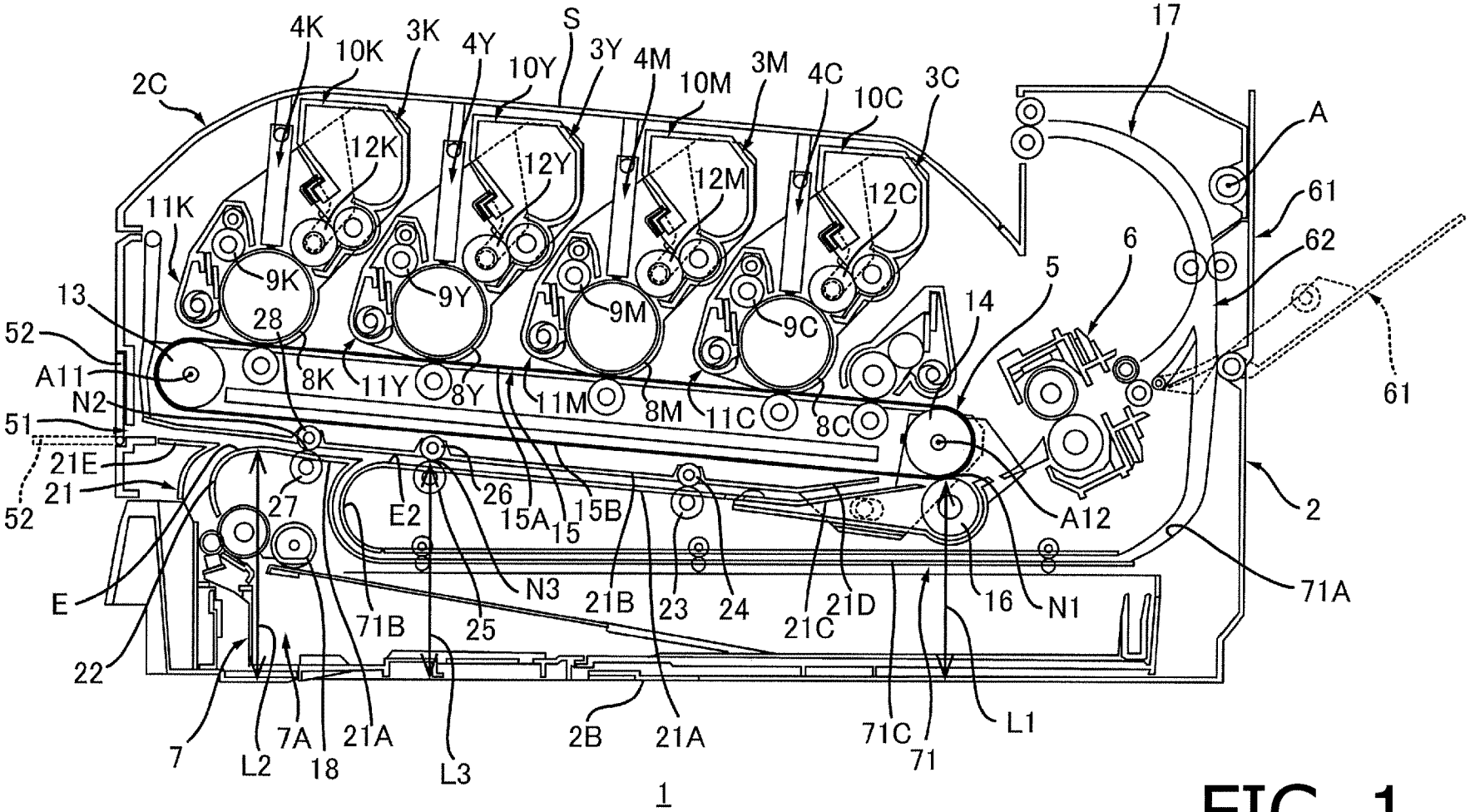
FIG. 1 is a cross-sectional view of an image forming apparatus according to a first embodiment of the present disclosure.

An overall configuration of the image forming apparatus 1 according to the first embodiment of the present disclosure will be described with reference to FIGS. 1 and 2. As shown in FIG. 1, the image forming apparatus 1 includes a housing 2, a plurality of, e.g., four (4), process cartridges 3K, 3Y, 3M, 3C, a plurality of, e.g., four (4), LED arrays 4K, 4Y, 4M, 4C, a transfer unit 5, a fuser 6, a first sheet tray 7, a pickup roller 18, a second sheet tray 52, a third sheet tray 61, a sheet guide 21, and a duplex-printing guide 71.

1.1 Housing

The housing 2 forms an outline of the image forming apparatus 1. The process cartridges 3K, 3Y, 3M, 3C are attachable to the housing 2, and when attached to the housing 2, the process cartridges 3K, 3Y, 3M, 3C are stored inside the housing 2. The housing 2 has an opening 2A (see FIG. 2) and a bottom surface 2B. The opening 2A allows the process cartridges 3K, 3Y, 3M, 3C to pass there-through in order for the process cartridges 3K, 3Y, 3M, 3C to be attached to and detached from the housing 2. While the image forming apparatus 1 is placed on a flat plane, the bottom surface 2B faces the flat plane. The housing 2 includes a top cover 2C, which is pivotable between an open position (see FIG. 2), in which the opening 2A is exposed, and a closure position, in which the opening 2A is closed. The top cover 2C is pivotable about an axis A, which extends in a predetermined axial direction. The top cover 2C includes an upper surface S, which inclines with respect to the bottom surface 2B when the top cover 2C is at the closure position. In particular, the upper face S of the top cover S inclines to be lower toward the axis A when the top cover 2C is at the closure position.

1.2 Process Cartridge

Figure 2:
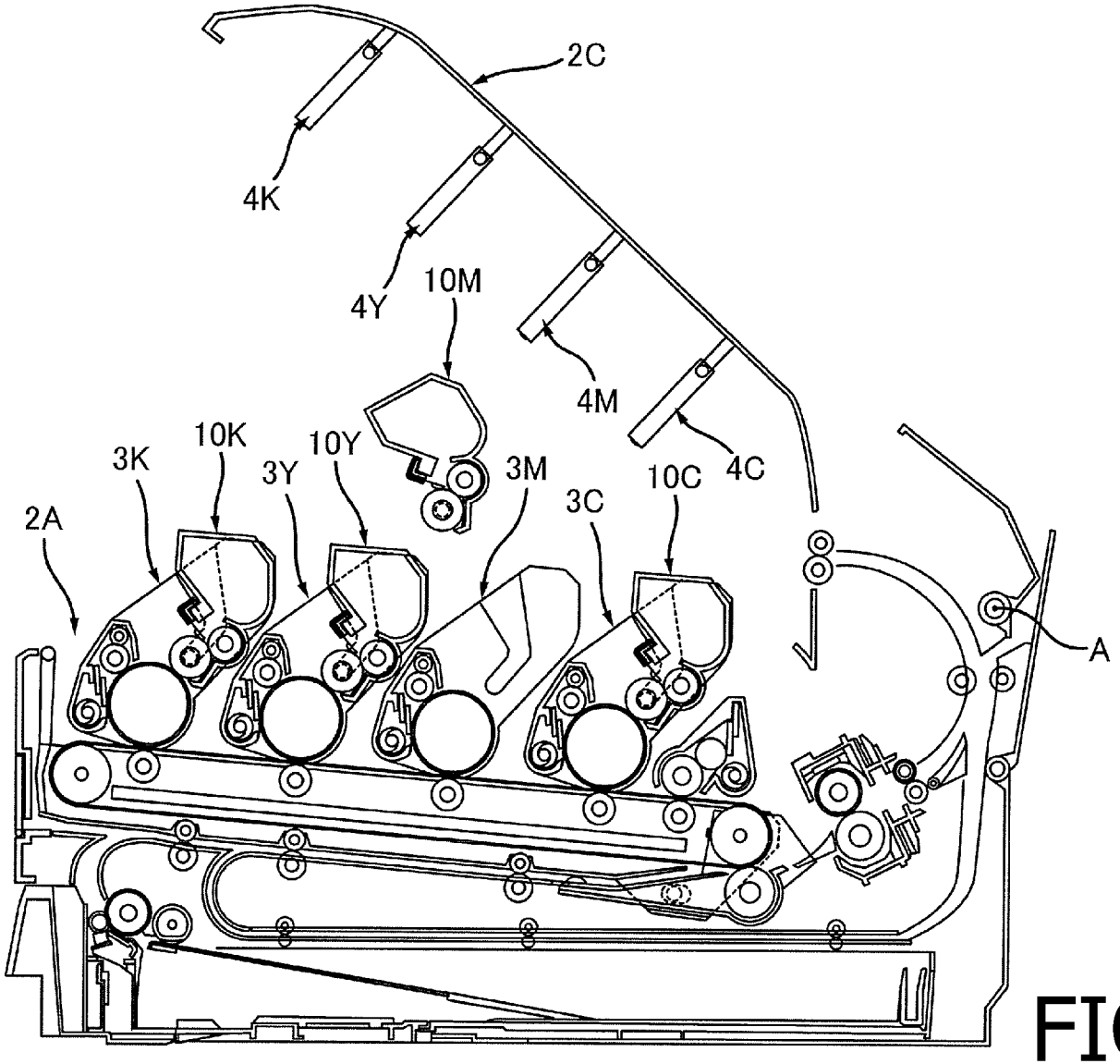
FIG. 2 is a cross-sectional view of the image forming apparatus according to the first embodiment of the present disclosure with a top cover being at an open position.

Each of the process cartridges 3K, 3Y, 3M, 3C is attachable to and detachable from the housing 2 through the opening 2A while the top cover 2C is in the open position (see FIG. 2). The process cartridges 3K, 3Y, 3M, 3C align along a first direction in the housing 2. Specifically, the process cartridges 3K, 3Y, 3M, 3C are spaced apart from one another along the first direction. The process cartridges 3K, 3Y, 3M, 3C are in a same structure; therefore, in the following description, the process cartridge 3K will represent the structure of the process cartridges 3K, 3Y, 3M, 3C, and description of the process cartridges 3Y, 3M, 3C may be omitted.

The process cartridge 3K includes a photosensitive drum 8K, a charger roller 9K, a developing unit 10K, and a drum cleaner 11K.

The charger roller 9K is arranged to contact a circumferential surface of the photosensitive drum 8K to charge the circumferential surface of the photosensitive drum 8K.

The developing unit 10K is, as shown in FIG. 2, attachable to and detachable from the process cartridge 3K. The developing unit 10K may supply toner to the circumferential surface of the photosensitive drum 8K. Specifically, the developing unit 10K may store the toner therein; and the developing unit 10K includes a developing roller 12K, which may supply the toner in the developing unit 10K to the circumferential surface of the photosensitive drum 8K. The developing roller 12K is arranged to contact the circumferential surface of the photosensitive drum 8K while the developing unit 10K is attached to the process cartridge 3K.

The drum cleaner 11K may remove the toner from the circumferential surface of the photosensitive drum 8K.

1.3 LED Arrays

The LED arrays 4K, 4Y, 4M, 4C are arranged to align along the first direction. Specifically, the LED arrays 4K, 4Y, 4M, 4C are spaced apart from one another along the first direction. The LED arrays 4K, 4Y, 4M, 4C are attached to the top cover 2C. The LED arrays 4K, 4Y, 4M, 4C are in a same structure; therefore, in the following description, the LED array 4K will represent the structure of the LED arrays 4K, 4Y, 4M, 4C, and description of the LED arrays 4Y, 4M, 4C may be omitted.

The LED array 4K may emit light so that the circumferential surface of the photosensitive drum 8K may be exposed to the light. While the process cartridge 3K is attached to the housing 2, and while the top cover 2C is in the closure position, the LED array 4K is located above the photosensitive drum 8K.

1.4 Transfer Unit

The transfer unit 5 may transfer toner images that are formed on the circumferential surfaces of the photosensitive drums 8K, 8Y, 8M, 8C to a sheet. The transfer unit 5 includes a first roller 13, a second roller 14, an intermediate transfer belt 15, and a secondary transfer roller 16. In this respect, the image forming apparatus 1 includes the first roller 13, the second roller 14, the intermediate transfer belt 15, and the secondary transfer roller 16.

The first roller 13 may drive the intermediate transfer belt 15 to circulate. The first roller 13 is rotatable about a first axis A11, which extends in the axial direction. The first roller 13 is a driving roller, to which a driving force may be input.

The second roller 14 may, in conjunction with the first roller 13, cause the intermediate transfer belt 15 to circulate. The second roller 14 nips the intermediate transfer belt 15 at a position between the second roller 14 and the secondary transfer roller 16. The second roller 14 is rotatable about a second axis A12, which extends in the axial direction. The second roller 14 is a driven roller, which may rotate along with the circulation of the intermediate transfer belt 15 being driven by the first roller 13.

The second roller 14 aligns with the first roller 13 along the first direction. Specifically, the second roller 14 is spaced apart from the first roller 13 and aligns with the first roller 13 along the first direction. The first direction is a direction that extends through the first axis A11 and the second axis A12. The second roller 14 is located at a lower position with respect to the first roller 13. Specifically, the second axis A12 may be located to be lower than the first axis A11.

The intermediate transfer belt 15 is located at a lower position with respect to the photosensitive drums 8K, 8Y, 8M, 8C and contacts the photosensitive drums 8K, 8Y, 8M, 8C. The intermediate transfer belt 15 is an endless belt strained around the first roller 13 and the second roller 14. Specifically, the intermediate transfer belt 15 extends in the first direction while the intermediate transfer belt 15 is strained around the first roller 13 and the second roller 14. The intermediate transfer belt 15 may circulate around the first roller 13 and the second roller 14. The intermediate transfer belt 15 is arranged to incline with respect to the bottom surface 2B. Specifically, the intermediate transfer belt 15 inclines to be lower toward the fuser 6. The intermediate transfer belt 15 includes a first part 15A and a second part 15B. The first part 15A is located between the first roller 13 and the second roller 14 and extends in the first direction. The first part 15A faces and contacts the photosensitive drum 8K, 8Y, 8M, 8C. The second part 15B is located on an opposite side to the first part 15A from the photosensitive drums 8K, 8Y, 8M, 8C. Specifically, the second part 15B is located at a lower position with respect to the first part 15A. The second part 15B is located between the first roller 13 and the second roller 14 and extends in the first direction.

The secondary transfer roller 16 may transfer the toner images, having been transferred from the photosensitive drums 8K, 8Y, 8M, 8C to the intermediate transfer belt 15, to the sheet. The secondary transfer roller 16 is located at a lower position with respect to the second roller 14 and contacts the intermediate transfer belt 15. Specifically, the secondary transfer roller 16 nips the intermediate transfer belt 15 at a position between the secondary transfer roller 16 and the second roller 14. The secondary transfer roller 16 is located between the second roller 14 and the first sheet tray 7 along a second direction, which intersects orthogonally with the first direction.

1.5 Fuser

The fuser 6 may apply heat and pressure to the sheet, which has the toner image transferred thereon, to fix the toner onto the sheet. The fuser 6 is located at a position on a side of the second roller 14 opposite to the first roller 13 in the first direction. The fuser 6 is spaced apart from the secondary transfer roller 16 in the first direction. The sheet passing through the fuser 6 may be guided upward by a discharge guide 17, while the third sheet tray 61 is in the closure position, to be ejected outside the housing 2 and placed on the top cover 2C.

1.6 First Sheet Tray

The first sheet tray 7 may store sheets therein. Specifically, the first sheet tray 7 includes a container 7A, in which the sheets are stored. The first sheet tray 7 is movable with respect to the housing 2 in the first direction. The first sheet tray 7 is movable between an outer position, in which the container 7A is outside the housing 2, and an inner position, in which the container 7A is inside the housing 2. Therefore, the first sheet tray 7 is movable to the outer position so that the sheets may be supplied in the container 7A. The first sheet tray 7 is, while the first sheet tray 7 is in the inner position, located at a lower position with respect to the intermediate transfer belt 15. While the first sheet tray 7 is at the inner position, the sheets in the first sheet tray 7 may be guided by a sheet guide 21, which will be described later in detail, to be conveyed to the position between the intermediate transfer belt 15 and the secondary transfer roller 16 at a predetermined timing. The first sheet tray 7 extends in the first direction and includes one end portion and the other end portion along the first direction. The one end portion is located at a lower position with respect to the first roller 13. The other end portion is apart from the one end portion in the first direction.

1.7 Pickup Roller

The pickup roller 18 may pick up the sheets from the first sheet tray 7 while the first sheet tray 7 is in the inner position. The pickup roller 18 is, while the first sheet tray 7 is in the inner position, located at an upper position with respect to the one end portion of the first sheet tray 7. The sheets picked up by the pickup roller 18 may be conveyed toward the sheet guide 21.

1.8 Second Sheet Tray

The second sheet tray 52 may support sheets thereon. The second sheet tray 52 is located at an upper position with respect to the first sheet tray 7. The housing 2 has an opening 51, which allows the sheets to be inserted there-through, and the second sheet tray 52 may support the sheets inserted through the opening 51. The second sheet tray 52 is movable between a first position, in which the second sheet tray 52 closes the opening 51, and a second position, in which the second sheet tray 52 opens the opening 51. The second sheet tray 52 may, while the second sheet tray 52 is at the second position, support the sheets.

1.9 Third Sheet Tray

The third sheet tray 61 may support the sheets passed through the fuser 6. The housing 2 has an opening 62, which allows the sheets conveyed through the fuser 6 to pass there through, and the third sheet tray 61 may support the sheets passed through the opening 62. The third sheet tray 61 is movable between a closure position, in which the third sheet tray 61 closes the opening 62, and an open position, in which the third sheet tray 61 opens the opening 62. The third sheet tray 61 may support the sheets passed through the fuser 6 while the third sheet tray 61 is at the open position. The sheets passed through the fuser 6 may be, while the third sheet tray 61 is at the open position, supported by the third sheet tray 61 without being guided by the discharge guide 17.

1.10 Sheet Guide

The sheet guide 21 may guide the sheets from the first sheet tray 7 to the position between the intermediate transfer belt 15 and the secondary transfer roller 16. The sheet guide 21 is located between the intermediate transfer belt 15 and the first sheet tray 7 with regard to the vertical direction.

1.11 Duplex-Printing Guide

The duplex-printing guide 71 may, while the third sheet tray 61 is in the closure position, and when the image forming apparatus 1 conducts a duplex-printing operation, guide the sheet passed through the fuser 6 once again to a contact area N1, which is between the intermediate transfer belt 15 and the secondary transfer roller 16.

2. Detailed Configuration of the Sheet Guide

The detailed configuration of the sheet guide 21 will be described below with reference to FIG. 1.

The sheet guide 21 includes a curved section 22, a first sheet guide 21A, a second sheet guide 21B, a third sheet guide 21C, a fourth sheet guide 21D, and a manual sheet-feeding guide 21E.

The curved section 22 may guide the sheets from the first sheet tray 7 upward. The curved section 22 is located at a lower position with respect to the first roller 13. The curved section 22 extends upward and curves with regard to the first direction toward the position between the intermediate transfer belt 15 and the secondary transfer roller 16. The contact area N1 between the intermediate transfer belt 15 and the secondary transfer roller 16 is located at a lower position with respect to an upper end portion E1 of the curved section 22. Specifically, the contact area N1 between the intermediate transfer belt 15 and the secondary transfer roller 16 is closer than the upper end portion E1 to the bottom surface 2B. In this regard, the secondary transfer roller 16 is located at a lower position with respect to the upper end portion E1 of the curved section 22, and the second roller 16 is closer than the upper end portion E1 of the curved section 22 to the bottom surface 2B. Therefore, a length L1 between the contact area N1 and the bottom surface 2B is smaller than a length L2 between the upper end portion E1 of the curved section 22 and the bottom surface 2B.

The first sheet guide 21A, the second sheet guide 21B, and the third sheet guide 21C may guide the sheets guided by the curved section 22 toward the position between the intermediate transfer belt 15 and the secondary transfer roller 16.

The first sheet guide 21A may guide the sheets along the first direction. The first sheet guide 21A is located at a position downstream from the curved section 22 with regard to a sheet conveying direction, in which the sheets may be conveyed. The first sheet guide 21A is located at a lower position with respect to the intermediate transfer belt 15. The first sheet guide 21A extends in the first direction and along the second part 15B of the intermediate transfer belt 15. The first sheet guide 21A inclines to be lower at a downstream side and higher at an upstream side with regard to the sheet conveying direction. The first sheet guide 21A extends along the intermediate transfer belt 15 and inclines with respect to the bottom surface 2B. The first sheet guide 21A forms a part of the housing 2, in other words, the housing 2 includes the first sheet guide 21A. The first sheet guide 21A includes a first sheet conveyer roller 27 and sheet conveyer rollers 25, 23; therefore the sheet guide 21 includes the first sheet conveyer roller 27 and the sheet conveyer rollers 25, 23. The sheet conveyer roller 25 is located at a position downstream from the first sheet conveyer roller 27 with regard to the sheet conveying direction, and the sheet conveyer roller 23 is located at a position downstream from the sheet conveyer roller 25 with regard to the sheet conveying direction. The sheet conveyer roller 23 may be a registration roller.

The second sheet guide 21B may guide the sheets along the first direction. The second sheet guide 21B is located at a position downstream from the curved section 22 with regard to the sheet conveying direction. The second guide 21B is arranged to face the first sheet guide 21A. The second sheet guide 21B is located at an upper position with respect to the first sheet guide 21A. The second sheet guide 21B extends in the first direction and along the second part 15B of the intermediate transfer belt 15. The second sheet guide 21B inclines to be lower at a downstream side and higher at an upstream side with regard to the sheet conveying direction. The second sheet guide 21B is located at the upper position with respect to the first sheet guide 21A spaced apart vertically from the first sheet guide 21A. The second sheet guide 21B is included in the transfer unit 5. In other words, the transfer unit 5 includes the second sheet guide 21B. The second sheet guide 21B includes a second sheet conveyer roller 28 and sheet conveyer rollers 26, 24; therefore, the sheet guide 21 includes the second sheet conveyer roller 28 and the sheet conveyer rollers 26, 24. The second sheet conveyer roller 28 is arranged to contact the first sheet conveyer roller 27. The sheet conveyer roller 26 is located at a position downstream from the second sheet conveyer roller 28 with regard to the sheet conveying direction. The sheet conveyer roller 26 is located at an upper position with respect to the secondary transfer roller 16. The sheet conveyer roller 24 is arranged to contact the sheet conveyer roller 23. The second conveyer roller 24 is located at a position downstream from the sheet conveyer roller 26 with regard to the sheet conveying direction.

A contact area N2 between the first sheet conveyer roller 27 and the second conveyer roller 28 is located at an upper position with respect to the contact area N1, which is between the intermediate transfer belt 15 and the secondary transfer roller 16. In other words, the contact area N1 between the intermediate transfer belt 15 and the secondary transfer roller 16 is located at a lower position with respect to the contact area N2 between the first sheet conveyer roller 27 and the second sheet conveyer roller 28. Meanwhile, a contact area N3 between the sheet conveyer roller 26 and the sheet conveyer roller 25 is located at an upper position with respect to the contact area N1 between the intermediate transfer belt 15 and the secondary transfer roller 16. Specifically, a length L3 between the contact area N3 and the bottom surface 2B is greater than the length L1 between the contact area N1 and the bottom surface 2B.

The third sheet guide 21C may guide the sheets to the contact area N1 between the intermediate transfer belt 15 and the secondary transfer roller 16. The third sheet guide 21C is located at a position downstream from the first sheet guide 21A with regard to the sheet conveying direction. The third sheet guide 21C inclines to be higher at a downstream side and lower at an upstream side with regard to the sheet conveying direction. Therefore, the third sheet guide 21C inclines upward to be closer to the second roller 14 as the third sheet guide 21C extends downstream along the sheet conveying direction. The third guide 21C is included in the transfer unit 5. In other words, the transfer unit 5 includes the third guide 21C.

The fourth sheet guide 21D may guide the sheets to the contact area N1 between the intermediate transfer belt 15 and the secondary transfer roller 16. The fourth guide 21D is arranged to face the third sheet guide 21C. The fourth sheet guide 21D is located at an upper position with respect to the third sheet guide 21C. The fourth guide 21D is spaced apart vertically from the third sheet guide 21C. The fourth sheet guide 21D is located at a position downstream from the second sheet guide 21B with regard to the sheet conveying direction. The fourth sheet guide 21D inclines upward to be closer to the intermediate transfer belt 15 as the fourth sheet guide 21D extends downstream along the sheet conveying direction. Therefore, the sheet conveyed between the third sheet guide 21C and the fourth sheet guide 21D may contact the intermediate transfer belt 15. Thereafter, the sheet may maintain the contact with the intermediate transfer belt 15 as being conveyed to the contact area N1 between the intermediate transfer belt 15 and the secondary transfer roller 16. In this regard, the sheet may be conveyed to the contact area N1 without leaving a gap between the sheet and the intermediate transfer belt 15. Therefore, when electricity is supplied to the secondary transfer roller 16, electrical discharge between the sheet and the intermediate transfer belt 15 may be restrained. Accordingly, the toner on the circumferential surface of the intermediate transfer belt 15, on an upstream side from the contact area N1 with regard to the sheet conveying direction, may be restrained from being charged in reverse polarity and scattering over the sheet.

The manual sheet-feeding guide 21E may guide the sheets, which are supported on the second sheet tray 52 and inserted through the opening 51, to the first sheet guide 21A and the second sheet guide 21B. The manual sheet-feeding guide 21 is located at an upper position with respect to the contact area N1 between the intermediate transfer belt 15 and the secondary transfer roller 16. Therefore, the opening 51 is located at an upper position with respect to the contact area N1. In other words, the contact area N1 between the intermediate transfer belt 15 and the secondary transfer roller 16 is located at a lower position with respect to the opening 51.

3. Detailed Configuration of the Duplex-Printing Guide

A detailed configuration of the duplex-printing guide 71 will be described below with reference to FIG. 1.

The duplex-printing guide 71 includes a curved section 71A, a sheet guide 71C, and a curved section 71B. The sheet guide 71C is located at a position downstream from the curved section 71A with regard to a sheet conveying direction within the duplex-printing guide 71. The curved section 71B is located at a position downstream from the sheet guide 71C with regard to the sheet conveying direction within the duplex-printing guide 71. The curved section 71A is located at a lower position with respect to the opening 62. An upper end portion E2 in the curved section 71B is located at an upper position with respect to the contact area N1 between the intermediate transfer belt 15 and the secondary transfer roller 16.

4. Detailed Configuration of the Second Sheet Tray

A detailed configuration of the second sheet tray 52 will be described below with reference to FIG. 1.

The second sheet tray 52 is located at an upper position with respect to the contact area N1 between the intermediate transfer belt 15 and the secondary transfer roller 16. The second sheet tray 52 is located at an upper position with respect to the secondary transfer roller 16 and a lower position with respect to the opening 51.

Therefore, the sheets supported on the second sheet tray 52 may be conveyed through the opening 51 and guided by the first sheet guide 21A, the second sheet guide 21B, the third sheet guide 21, and the fourth sheet guide 21D to the position between the intermediate transfer belt 15 and the secondary transfer roller 16 without being conveyed through the curved section 22. In this regard, for example, when the sheet to be conveyed is a thicker sheet or an envelope, the sheet may be conveyed to the position between the intermediate transfer belt 15 and the secondary transfer roller 16 without being bended or curled.

Further, while the third sheet tray 61 is in the open position, the sheets may be guided through the position between the intermediate transfer belt 15 and the secondary transfer roller 16 without being conveyed through the curved section 22 and, after being conveyed through the fuser 6, guided to the third sheet tray 61 without being conveyed through the discharge guide 17. According to this conveying flow, for example, when the sheet to be conveyed is a thicker sheet or an envelope, the sheet may be discharged outside the housing 2 without being bended or curled.

5. Transfer Unit

A detailed configuration of the transfer unit 5 will be described below with reference to FIGS. 3-7.

Figure 3:
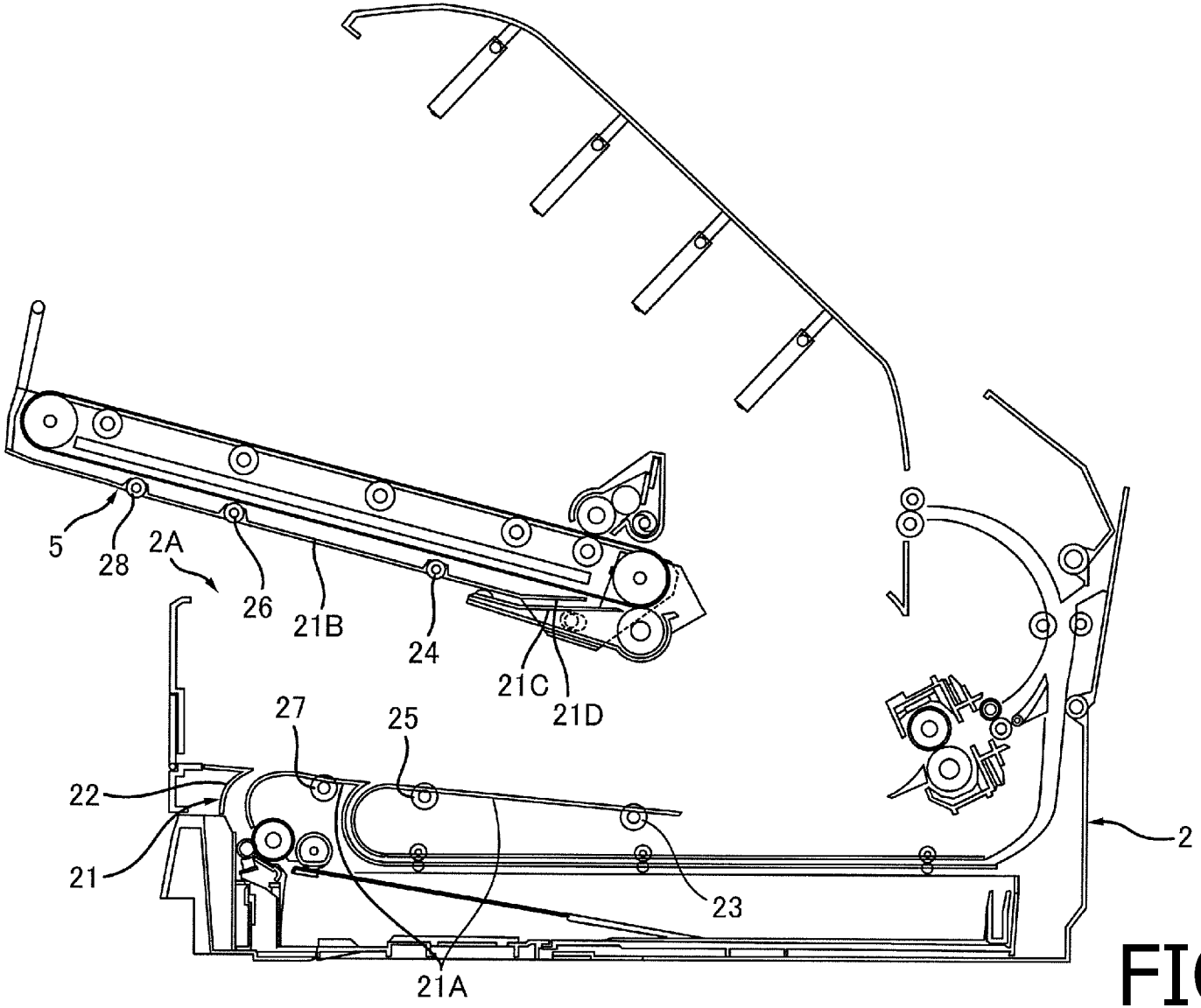
FIG. 3 is an illustrative view of the image forming apparatus according to the first embodiment of the present disclosure with a transfer unit being attached to or detached form a housing.

As shown in FIG. 3, the transfer unit 5 is attachable to and detachable from the housing 2. Specifically, the transfer unit 5 is attachable to and detachable from the housing 2 through the opening 2A while the photosensitive drums 8K, 8Y, 8M, 8C (see FIG. 2) are all removed from the housing 2. More specifically, the transfer unit 5 is attachable to and detachable from the housing 2 through the opening 2A while the process cartridges 3K, 3Y, 3M, 3C (see FIG. 2) are all removed from the housing 2.

As the transfer unit 5 is detached from the housing 2, the second sheet guide 21B is separated from the first sheet guide 21A. In other words, removal of the transfer unit 5 from the housing 2 may separate the second sheet conveyer roller 28 from the first sheet conveyer roller 27, the conveyer roller 25 from the conveyer roller 26, and the conveyer roller 23 from the conveyer roller 24. Therefore, when, for example, a sheet is jammed at a position between the first sheet guide 21A and the second sheet guide 21B, a user may remove the transfer unit 5 from the housing 2 to access the jammed sheet and remove the jammed sheet therefrom. The transfer unit 5 includes the third sheet guide 21C and the fourth sheet guide 21D.

Figure 4:
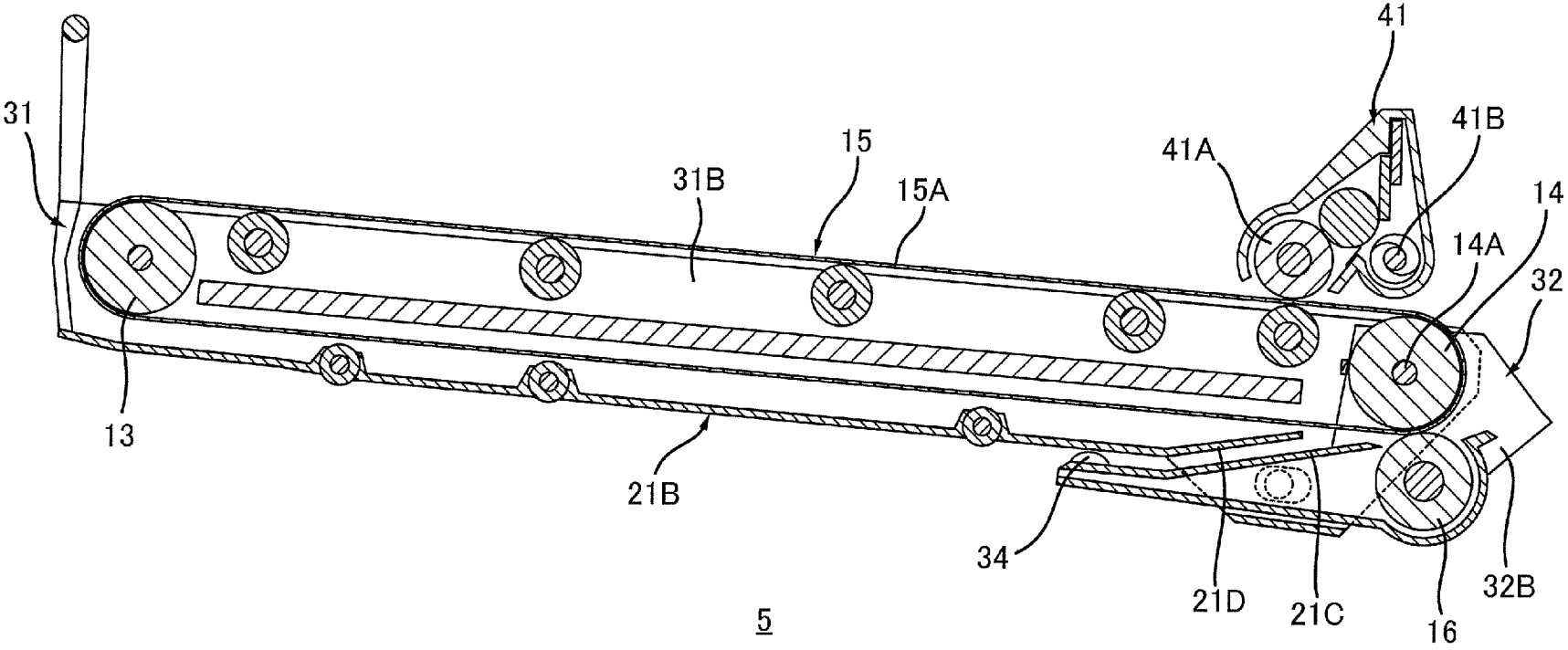
FIG. 4 is a cross-sectional view of the transfer unit for the image forming apparatus according to the first embodiment of the present disclosure.
Figure 6:
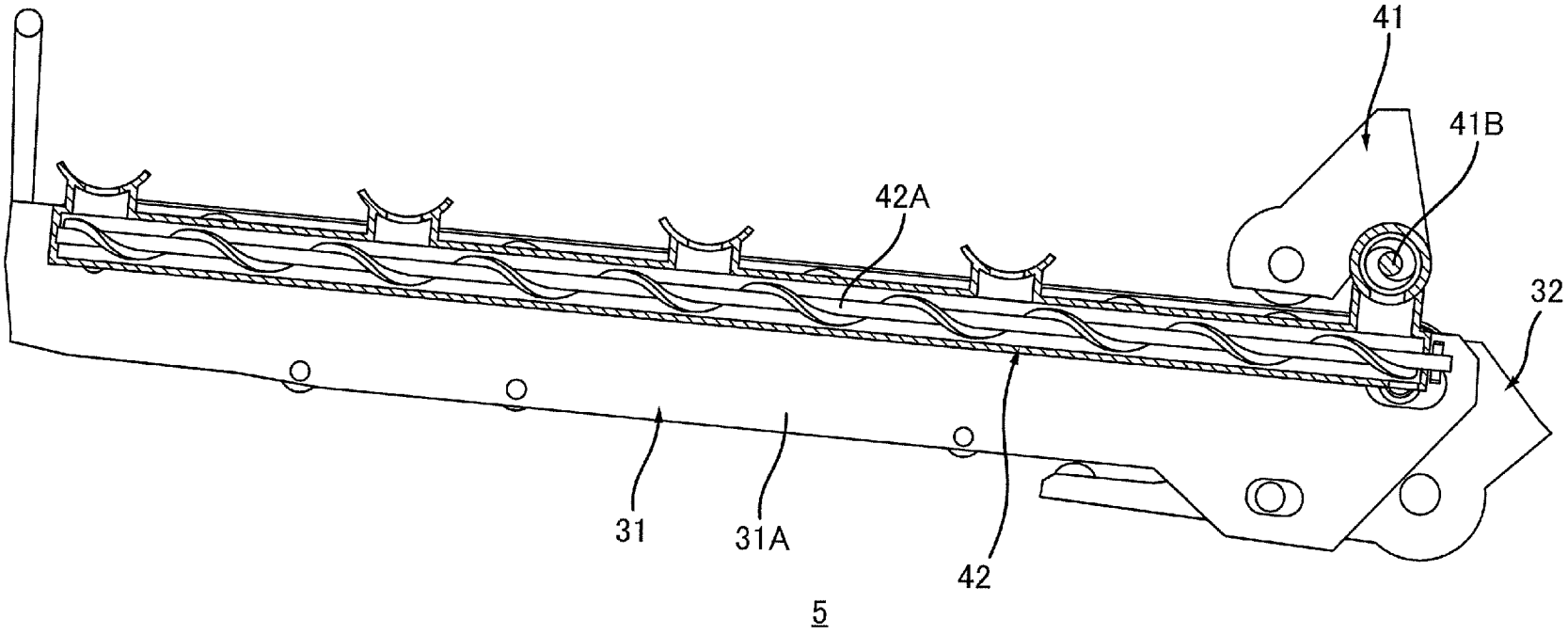
FIG. 6 is a cross-sectional view of the conveyer tube in the transfer unit for the image forming apparatus according to the first embodiment of the present disclosure.

As shown in FIGS. 4 and 6, the transfer unit 5 includes a first frame 31, a second frame 32, a belt cleaner 41, and a conveyer tube 42.

5.1 First Frame and Second Frame

Figure 5:
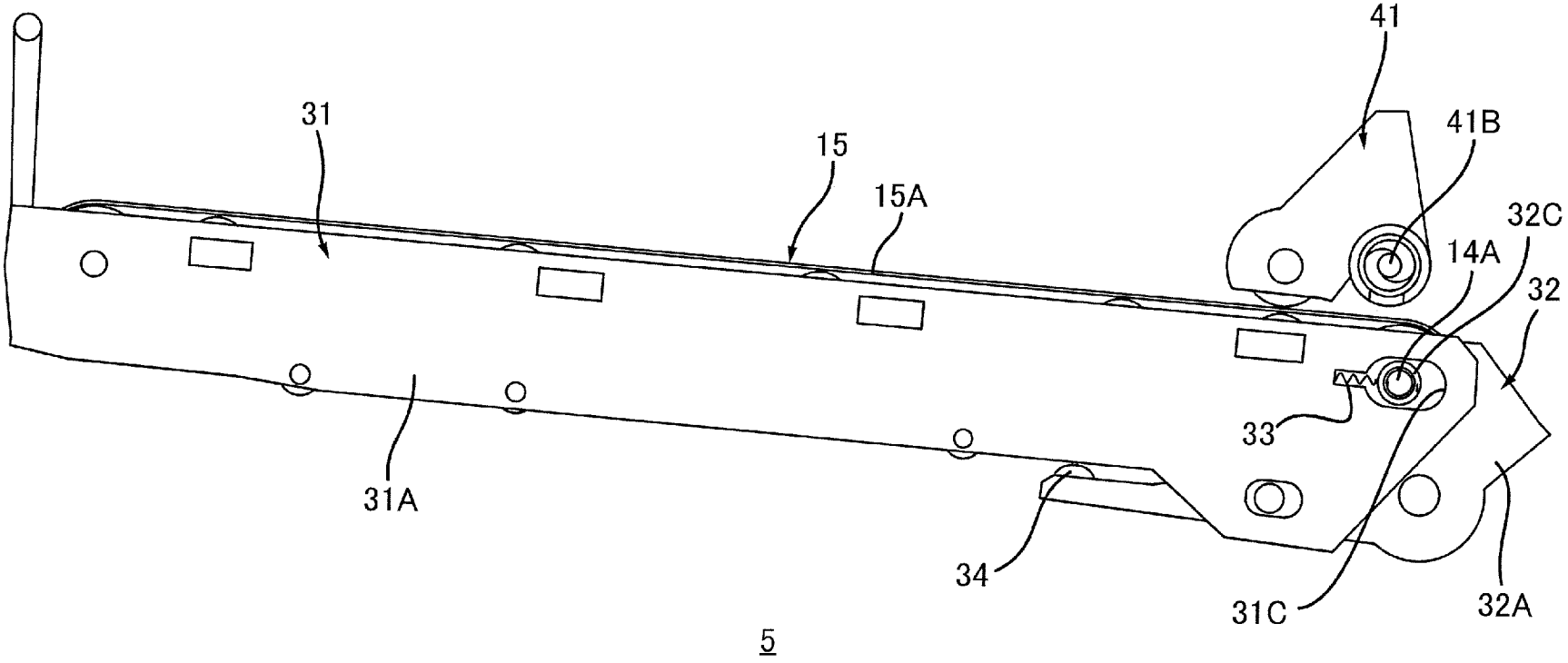
FIG. 5 is a sideward view of the transfer unit for the image forming apparatus according to the first embodiment of the present disclosure with a conveyer tube being removed.

As shown in FIGS. 4 and 5, the first frame 31 supports the first roller 13. The first frame 31 includes the second sheet guide 21B and the fourth sheet guide 21D. The first frame 31 includes two (2) lateral plates 31A, 31B, which are spaced apart from each other along the axial direction. The lateral plates 31A, 31B extend in the first direction. Meanwhile, the first roller 13 is located between the lateral plate 31A and the lateral plate 31B along the axial direction. The second sheet guide 21B is located between the lateral plate 31A and the lateral plate 31B along the axial direction. Each of the lateral plates 31A, 31B has an elongated hole 31C, which is elongated in the sheet conveying direction. Specifically, the elongated holes 31C are elongated in the first direction.

The second frame 32 supports the second roller 14 and the secondary transfer roller 16. The second frame 32 includes the third sheet guide 21C. The second frame 32 is movable with respect to the first frame 31 in the sheet conveying direction. In other words, the second frame 32 is movable with respect to the first frame 31 in the first direction. Specifically, the second frame 32 is located between the lateral plate 31A and the lateral plate 31B along the axial direction. The second frame 32 includes two (2) lateral plates 32A, 32B, which are spaced apart from each other along the axial direction. The lateral plates 32A, 32B extend in the first direction. The second roller 14 is located between the lateral wall 32A and the lateral plate 32B along the axial direction. The lateral plates 32A, 32B support the second roller 14. The third sheet guide 21C is located between the lateral plate 32A and the lateral plate 32B along the axial direction. Each of the lateral plates 32A, 32B has a boss 32C, which has a cylindrical shape. The boss 32C on the lateral plate 32A extends in the axial direction toward the lateral plate 31A. The boss 32C on the lateral plate 32B extends in the axial direction toward the lateral plate 31B. The boss 32C on the lateral plate 32A is inserted in the elongated hole 31C in the lateral plate 31A, and the boss 32C on the lateral plate 32B is inserted in the elongated hole 31C in the lateral plate 31B. Therefore, the second frame 32 is supported by the first frame 31 and is movable with respect to the first frame 31 in the sheet conveying direction, in other words, in the first direction. In each boss 32C, inserted is a shaft 14A of the second roller 14. The bosses 32C are urged by springs 33 in a direction to be away from the first roller 13 along the first direction. Therefore, the second roller 14 and the second frame 32 are urged in the direction to be away from the first roller 13 along the first direction. In other words, the second roller 14 and the secondary transfer roller 16 are movable with respect to the first roller 13 in the first direction. The second frame 32 includes a protrusive part 34.

The protrusive part 34 is located between the third sheet guide 21C and the fourth sheet guide 21D. The protrusive part 34 contacts the fourth sheet guide 21D. The protrusive part 34 protrudes from the third sheet guide 21C at the fourth sheet guide 21D. Specifically, the protrusive part 34 protrudes from axial end areas of the third sheet guide 21C to the fourth sheet guide 21D. In this regard, the protrusive part 34 includes a plurality of protrusive parts 34. Thus, the protrusive parts 34 may maintain an amount of a gap between the third sheet guide 21C and the fourth sheet guide 21D constant. Thereby, the sheets guided to the position between the first guide 21A and the second sheet guide 21D may be conveyed through the gap between the third sheet guide 21C and the fourth sheet guide 21D.

5.2 Belt Cleaner

The belt cleaner 41, as shown in FIG. 4, may remove the toner from the surface of the intermediate transfer belt 15. The belt cleaner 41 is located at an upper position with respect to the second roller 14. The belt cleaner 41 is fixed to the first frame 31 through the conveyer tube 42. The belt cleaner 41 includes a cleaning roller 41A and an auger 41B.

The cleaning roller 41A contacts the surface of the intermediate transfer belt 15 and removes the toner from the surface of the intermediate transfer belt 15. The toner removed from the surface of the intermediate transfer belt 15 by the cleaning roller 41A may be stored inside the belt cleaner 41. The auger 41B is located inside the belt cleaner 41. The auger 41B extends in the axial direction and may convey the toner stored inside the belt cleaner 41 in the axial direction.

5.3 Conveyer Tube

Figure 7:
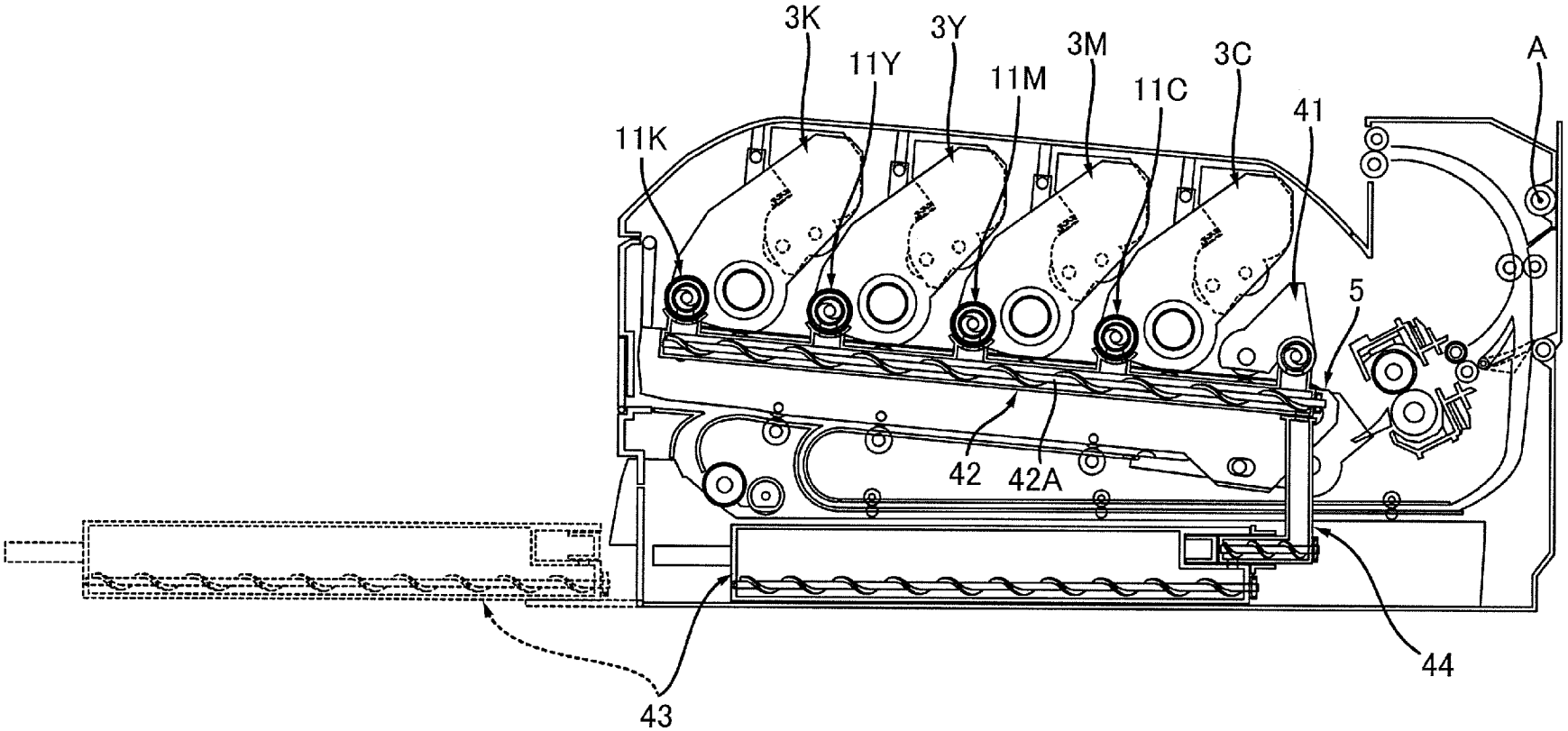
FIG. 7 is a cross-sectional view of the image forming apparatus according to the first embodiment of the present disclosure with a toner-conveying structure to convey waste toner.

The conveyer tube 42, as shown in FIGS. 6 and 7, may convey the toner removed by the drum cleaners 11K, 11Y, 11M, 11C and the belt cleaner 41 to a waste toner container 43, which will be described later.

The conveyer tube 42 is attached to the lateral plate 31A of the first frame 31. The conveyer tube 42 extends in the first direction. The conveyer tube 42 inclines downward, while the transfer unit 5 is attached to the housing 2, to be lower as the conveyer tube 42 extends closer to the axis A in the first direction. The conveyer tube 42 includes one end and the other end along the first direction. The first end is closer than the other end to the axis A with regard to the first direction. The conveyer tube 42 is coupled to the belt cleaner 41 at the one end. Therefore, the conveyer tube 42 may accept the toner conveyed by the auger 41B. The conveyer tube 42 is, while the transfer unit 5 and the process cartridges 3K, 3Y, 3M, 3C are attached to the housing 2, coupled with the drum cleaners 11K, 11Y, 11M, 11C at positions between the one end and the other end. Thereby, the conveyer tube 42 may accept the toner from the drum cleaners 11K, 11Y, 11M, 11C. Meanwhile, the conveyer tube 42 includes an auger 42A therein. The auger 42A extends in the first direction along the conveyer tube 42 and may convey the toner in the conveyer tube 42 in the first direction.

6. Waste Toner Container

A detailed configuration of the waste toner container 43 will be described below with reference to FIG. 7.

The image forming apparatus 1 includes the waste toner container 43. The waste toner container 43 may store the toner conveyed by the conveyer tube 42 therein. The waste toner container 43 is attachable to and detachable from the housing 2. The waste toner container 43 is, while the transfer unit 5 and the waste toner container 43 are attached to the housing 2, located at a lower position with respect to the conveyer tube 42. While the waste toner container 43 is attached to the housing 2, the waste toner container 43 aligns with the first sheet tray 7 along the axial direction. Further, while the waste toner container 43 is attached to the housing 2, the waste toner container 43 is connected with the one end of the conveyer tube 42 through a connector tube 44. Thereby, while the waste toner container 43 is attached to the housing 2, the waste toner container 43 may accept and accommodate the toner conveyed by the conveyer tube 42 therein.

7. Benefits

According to the image forming apparatus 1 described above, as shown in FIG. 1, the secondary transfer roller 16 is located at the lower position with respect to the upper end portion E1 of the curved section 22. Therefore, the secondary transfer roller 16 is arranged vertically in proximity to the first sheet tray 7.

In this arrangement, the space between the intermediate transfer belt 15 and the first tray 7 may be vertically reduced.

Further, a curvature of the curved section 22 may be enlarged, and the sheets conveyed through the curved section 22 may be restrained from being curled.

In other words, a volume of the image forming apparatus 1 may be reduced in the vertical direction, and the sheets may be restrained from being deformed.

According to the image forming apparatus 1 described above, further, as shown in FIG. 1, the intermediate transfer belt 15 is strained around the two (2) rollers, which are the first roller 13 and the second roller 14.

Therefore, compared to an image forming apparatus with an intermediate transfer belt strained around three rollers, the transfer unit 5 may be vertically downsized.

In other words, the image forming apparatus 1 may be downsized.

Meanwhile, it may be noted that, if a gap is left between the intermediate transfer belt 15 and the sheet at an upstream position with regard to the sheet conveying direction from the contact area N1, which is between the intermediate transfer belt 15 and the secondary transfer roller 16, and when electricity is supplied to the secondary transfer roller 16, electrical discharge may occur between the sheet and the intermediate transfer belt 15. With the electrical discharge, the toner on the circumferential surface of the intermediate transfer belt 15 may be charged in the reverse polarity, and the toner may not be transferred preferably.

According to the image forming apparatus 1 described above, meanwhile, as shown in FIG. 1, the secondary transfer roller 16 is located between the second roller 14 and the first sheet tray 7 with regard to the vertical direction, and the first sheet guide 21A extends along the second part 15B of the intermediate transfer belt 15. Further, the third sheet guide 21C and the fourth sheet guide 21D extend along the second part 21B of the intermediate transfer belt 15 and incline with respect to the bottom surface 2B of the housing 2 to be closer to the second roller 14.

Therefore, the gap between the intermediate transfer belt 15 and the sheet on the upstream side with regard to the sheet conveying direction from the contact area N1 may be reduced.

Accordingly, the electrical discharge between the sheet and the intermediate transfer belt 15 may be restrained, and the toner may be transferred to the sheet preferably.

8. More Example

Although an example of carrying out the present disclosure have been described, those skilled in the art may recognize that there are numerous variations and permutations of the image forming apparatus that fall within the spirit and scope of the invention as set forth in the appended claims. It may be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

For example, the belt cleaner 41 may not necessarily be fixed to the first frame 31 but may be fixed to the second frame 32 so that the belt cleaner 41 may be movable along with the second roller 14.

Second Embodiment

An image forming apparatus 100 according to a second exemplary embodiment of the present disclosure will be described with reference to FIGS. 8 and 9. In the following description, items or structures which are the same as or similar to the items or the structure described in the previous embodiment will be referred to by the same reference signs, and description of those will be omitted.

1. Sheet Feeder Roller

The image forming apparatus 100 includes a sheet feeder roller, which may feed the sheets supported on the first sheet tray 52.

The sheet feeder roller 101 is located between the second sheet tray 52 and the sheet guide 21 along the first direction. The sheet feeder roller is located at a lower position with respect to the first roller 13, in particular, between the first roller 13 and the first sheet tray 7 with regard to the vertical direction.

2. Laser Scanning Unit

The image forming apparatus 100 has a laser scanner unit 102 in place of the LED arrays 4K, 4Y, 4M, 4C in the image forming apparatus 1 described in the first embodiment. The laser scanner unit 102 may emit laser beams at the photosensitive drums 8K, 8Y, 8M, 8C so that the photosensitive drums 8K, 8Y, 8M, 8C may be exposed to the laser beams.

3. Process Cartridge

The image forming apparatus 100 has a plurality of process cartridges 103K, 103Y, 103M, 103C in place of the process cartridges 3K, 3Y, 3M, 3C in the image forming apparatus 1 described in the first embodiment. The process cartridges 103K, 103Y, 103M, 103C are in a same structure; therefore, in the following description, the process cartridge 103K will represent the structure of the process cartridges 103K, 103Y, 103M, 103C, and description of the process cartridges 103Y, 103M, 103C may be omitted.

The process cartridge 103K includes a developing unit 105. The process cartridge 103K and the developing unit 105K are integral with each other. Therefore, the process cartridge 103K and the developing unit 105K are inseparable from each other.

4. Drawer

The image forming apparatus 100 further includes a drawer 106, which may support the process cartridges 103K, 103Y, 103M, 103C.

Figure 8:
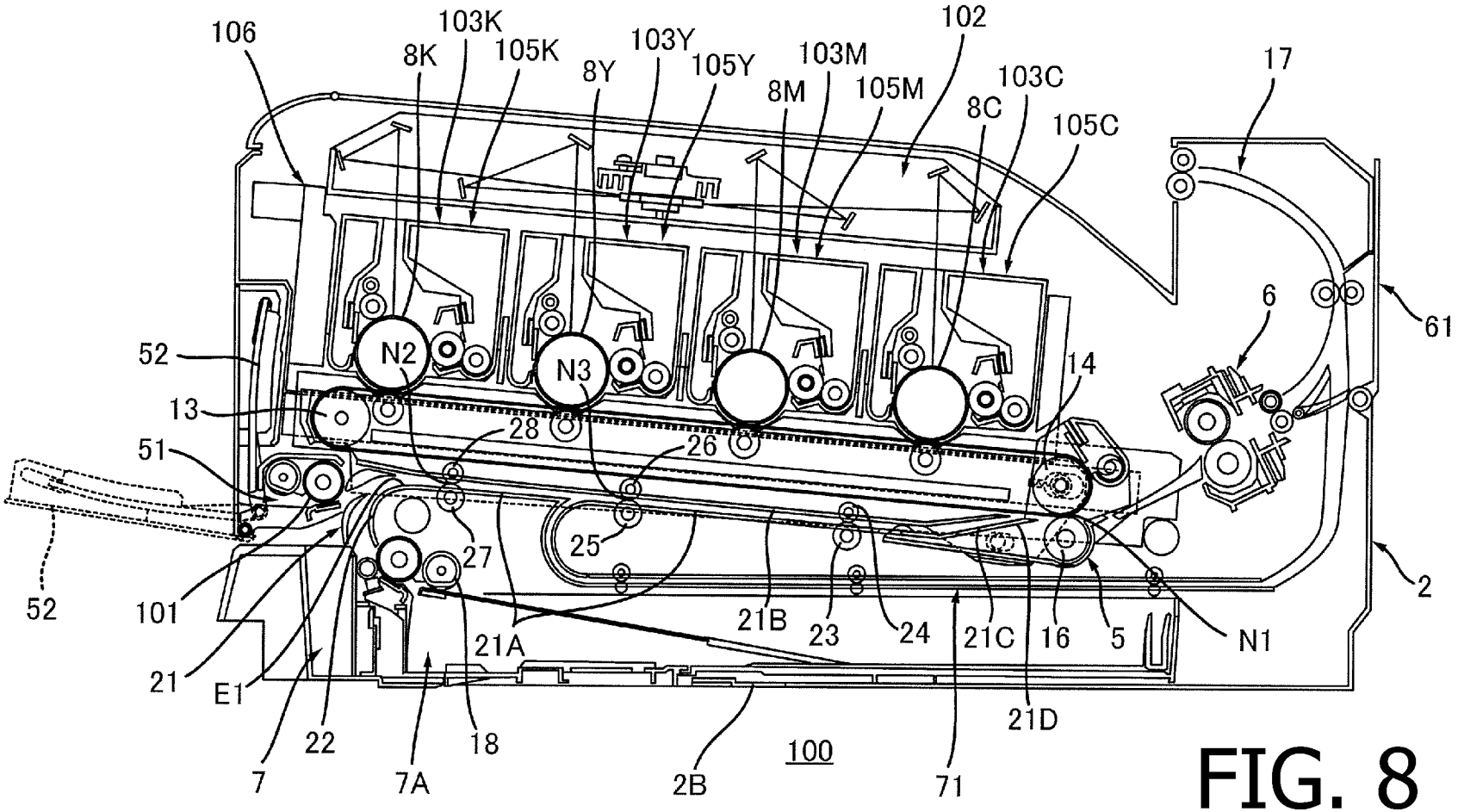
FIG. 8 is a cross-sectional view of an image forming apparatus according to a second embodiment of the present disclosure.
Figure 9:
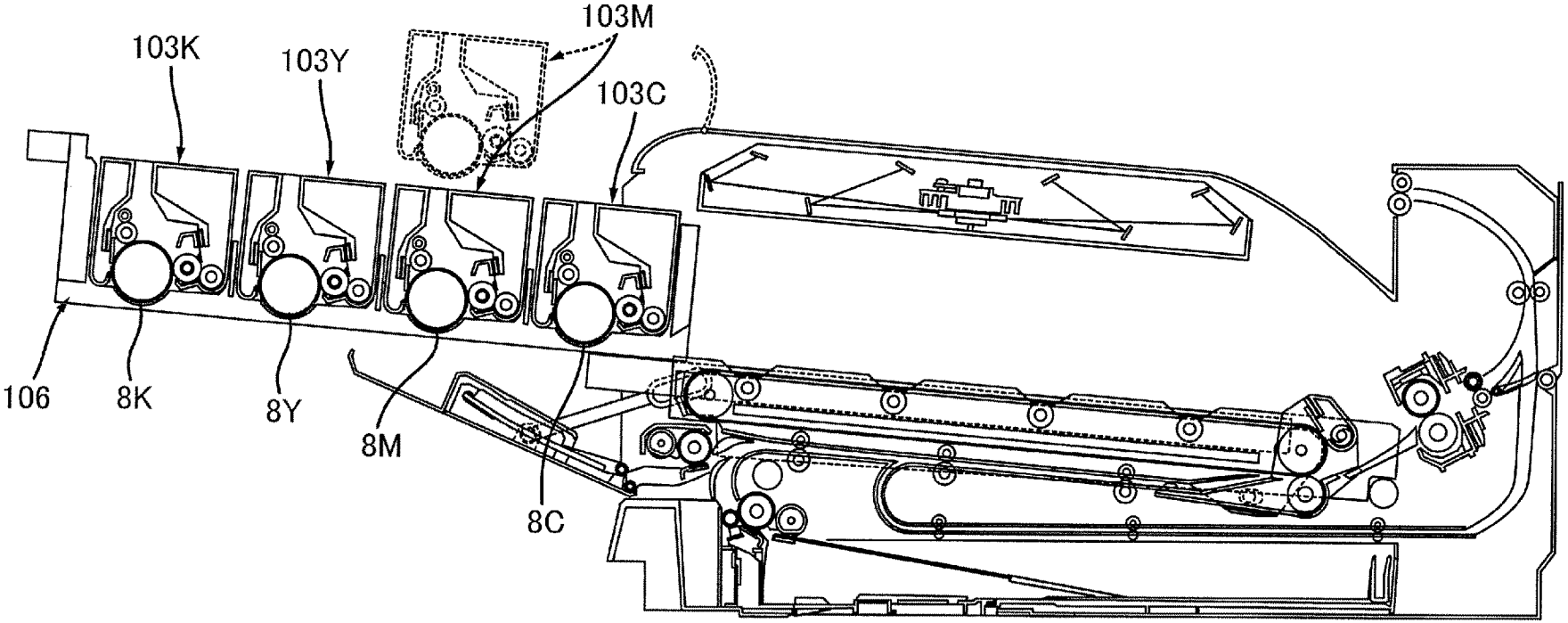
FIG. 9 is a cross-sectional view of the image forming apparatus according to the second embodiment of the present disclosure with a drawer being at an outer position.

The drawer 106 is, as shown in FIGS. 8 and 9, movable between an inner position, in which the drawer 106 is stored in the image forming apparatus 101, and an outer position, in which the drawer 106 is outside the image forming apparatus 100. The process cartridges 103K, 103Y, 103M, 103C are attachable to and detachable from the drawer 106 while the drawer 106 is at the outer position.

5. Benefits

According to the second embodiment, the benefits achievable by the image forming apparatus 1 described in the first embodiment may similarly be achievable.

What is claimed is:

1. An image forming apparatus, comprising:

a housing;

a drum cartridge detachably attachable to the housing, the drum cartridge including a photosensitive drum and a drum cleaner contacting the photosensitive drum;

a transfer unit detachably attachable to the housing, the transfer unit including:

an intermediate transfer belt contacting the photosensitive drum in a state where the transfer unit is attached to the housing, and a conveyer tube configured to store a first waste toner removed from the photosensitive drum by the drum cleaner in a state where the drum cartridge is attached to the housing; and a waste toner container configured to store the first waste toner conveyed by the conveyer tube therein in a state where the transfer unit is attached to the housing.

2. The image forming apparatus according to claim 1, wherein the transfer unit includes a belt cleaner contacting the intermediate transfer belt.

3. The image forming apparatus according to claim 2, wherein the conveyer tube is configured to store a second waste toner removed from the intermediate transfer belt by the belt cleaner.

4. The image forming apparatus according to claim 3, wherein the waste toner container is configured to store the second waste toner conveyed by the conveyer tube therein.

5. The image forming apparatus according to claim 1, wherein the waste toner container is detachably attachable to the housing in a state where the drum cartridge and the transfer unit are attached to the housing.

6. The image forming apparatus according to claim 1, wherein the drum cartridge is detachably attachable to the housing in a first direction, and wherein the waste toner container is detachably attachable to the housing in a second direction crossing the first direction.

7. The image forming apparatus according to claim 6, wherein the transfer unit is detachably attachable to the housing in the first direction.

8. The image forming apparatus according to claim 1, further comprising a developing cartridge detachably attachable to the housing, the developing cartridge including a developing roller.

9. The image forming apparatus according to claim 1, wherein the conveyer tube includes an auger configured to convey the first waste toner.

10. The image forming apparatus according to claim 9, wherein the auger extends in a third direction, and wherein the photosensitive drum is rotatable about a drum axis extending in a fourth direction crossing the third direction.

11. The image forming apparatus according to claim 1, wherein the waste toner container is positioned below the drum cartridge.

12. The image forming apparatus according to claim 1, wherein the waste toner container is positioned below the intermediate transfer belt.

13. The image forming apparatus according to claim 1, wherein the waste toner container is positioned below the conveyer tube.

14. The image forming apparatus according to claim 1, further comprising a first sheet tray configured to store a sheet, the first sheet tray aligning with the waste toner container in a direction.

15. The image forming apparatus according to claim 14, wherein the photosensitive drum is rotatable about a drum axis extending in the direction.

16. An image forming apparatus, comprising:

a housing;

a drum cartridge detachably attachable to the housing, the drum cartridge including a photosensitive drum;

a transfer unit detachably attachable to the housing, the transfer unit including:

an intermediate transfer belt contacting the photosensitive drum in a state where the transfer unit is attached to the housing, a belt cleaner contacting the intermediate transfer belt, and a conveyer tube configured to store a waste toner removed from the intermediate transfer belt by the belt cleaner; and a waste toner container configured to store the waste toner conveyed by the conveyer tube therein in a state where the transfer unit is attached to the housing.

* * * * *